US011672275B2

(12) United States Patent
Arellano et al.

(10) Patent No.: US 11,672,275 B2
(45) Date of Patent: Jun. 13, 2023

(54) CIGAR CLAMP HOLDER

(71) Applicant: STYNGER INC., McKinney, TX (US)

(72) Inventors: Richard Arellano, McKinney, TX (US); Ray Sadler, Fairview, TX (US)

(73) Assignee: STYNGER INC., McKinney, TX (US)

( * ) Notice: Subject to any disclaimer, the term of this patent is extended or adjusted under 35 U.S.C. 154(b) by 4 days.

(21) Appl. No.: 17/020,422

(22) Filed: Sep. 14, 2020

(65) Prior Publication Data

US 2021/0092996 A1 Apr. 1, 2021

Related U.S. Application Data

(60) Provisional application No. 62/907,738, filed on Sep. 30, 2019.

(51) Int. Cl.
*A24F 13/08* (2006.01)

(52) U.S. Cl.
CPC ..... *A24F 13/08* (2013.01)

(58) Field of Classification Search
CPC ..... A24F 13/08; A24F 13/22; A24F 13/02; A24F 13/00; A24F 19/0064; A24F 13/16; A24F 19/0035; A24F 13/26; A24F 19/105; Y10T 16/00; Y10T 16/52; Y10T 16/534; Y10T 16/5345; Y10T 403/4345; Y10T 403/1922; Y10T 403/1938
See application file for complete search history.

(56) References Cited

U.S. PATENT DOCUMENTS

| | | | | |
|---|---|---|---|---|
| 1,641,517 | A * | 9/1927 | Yessaian | A24F 13/22 131/258 |
| 10,172,399 | B1 * | 1/2019 | Rivers | A41D 19/0024 |
| 2015/0201672 | A1 * | 7/2015 | Tschan, II | A24D 1/16 40/321 |
| 2015/0257553 | A1 * | 9/2015 | Mackay | E05D 7/12 16/232 |
| 2018/0274699 | A1 * | 9/2018 | Ratzlaff | F16L 3/1075 |

* cited by examiner

*Primary Examiner* — Michael H. Wilson
*Assistant Examiner* — Stephanie Lynn Moore

(57) ABSTRACT

The present application is directed to a cigar holder that rests against a cigar to effectively clamp the cigar in a partially open clamp rested position. The cigar holder includes a top portion of a clamp with a cavity in which a material is disposed which is different from a material of the top portion of the clamp, a bottom portion of the clamp with a cavity in which the material is disposed, and a hinge disposed between the top portion of the clamp and the bottom portion of the clamp with a pass-through slot for an axis pin disposed inside a torsion spring with its torsion spring arms resting on both the top portion of the clamp and the bottom portion of the clamp.

5 Claims, 9 Drawing Sheets

CIGAR CLAMP HOLDER

CROSS-REFERENCE TO RELATED APPLICATION

The present application claims priority to earlier filed provisional patent application No. 62/907,738 entitled "CIGAR CLAMP HOLDER", filed on Sep. 30, 2019, the entire contents of which are hereby incorporated by reference in their entirety.

FIELD OF INVENTION

The present application relates to a cigar holder and more specifically to a hinged clamp that rests against the surface of a cigar.

BACKGROUND OF THE INVENTION

Conventionally, cigars are held by a cigar smoker's hand. Over the course of a cigar smoke session, the portion that is held by the smoker's hand can become soft, disfigured, too hot to touch, etc. The result of hand holding is often a wasted portion of the cigar and/or fatigue for the cigar smoker since the burning cigar has few places that it can be put down without fear of causing a fire or making a mess from cigar ash. Cigars vary in size and shape and there is no perfect fitted device for the varying volume, area and/or circumference of a cigar.

SUMMARY OF THE INVENTION

Example embodiments of the present application disclose a clamp that rests against the surface of a cigar.

One example embodiment may include an apparatus that includes a top portion of a clamp comprising a cavity in which a material is disposed which is different from a material of the top portion of the clamp, a bottom portion of the clamp comprising a cavity in which the material is disposed, and a hinge disposed between the top portion of the clamp and the bottom portion of the clamp with a pass-through slot for an axis pin disposed inside a torsion spring with its torsion spring arms resting on both the top portion of the clamp and the bottom portion of the clamp.

Another example embodiment may include an apparatus that includes a top portion of a clamp, a bottom portion of the clamp hinged to the top portion via an axis pin and a torsion spring, wherein the bottom portion of the clamp comprises a handle, and a base plate with two angled protrusions, the first angled protrusion being taller in height than the second angled protrusion, and wherein the handle rests between the two angled protrusions to hold the clamp in an angled position.

DETAILED DESCRIPTION

It will be readily understood that the components of the present application, as generally described and illustrated in the figures herein, may be arranged and designed in a wide variety of different configurations. Thus, the following detailed description of the embodiments of an apparatus, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

According to example embodiments, a C-shaped clamp provides a support for an inserted element, such as a cigar to rest under the weight of the top portion of the clamp. The clamp rests in a partially open position, which varies depending on a size of the cigar resting inside the C-shaped clamp.

Figure 1A:
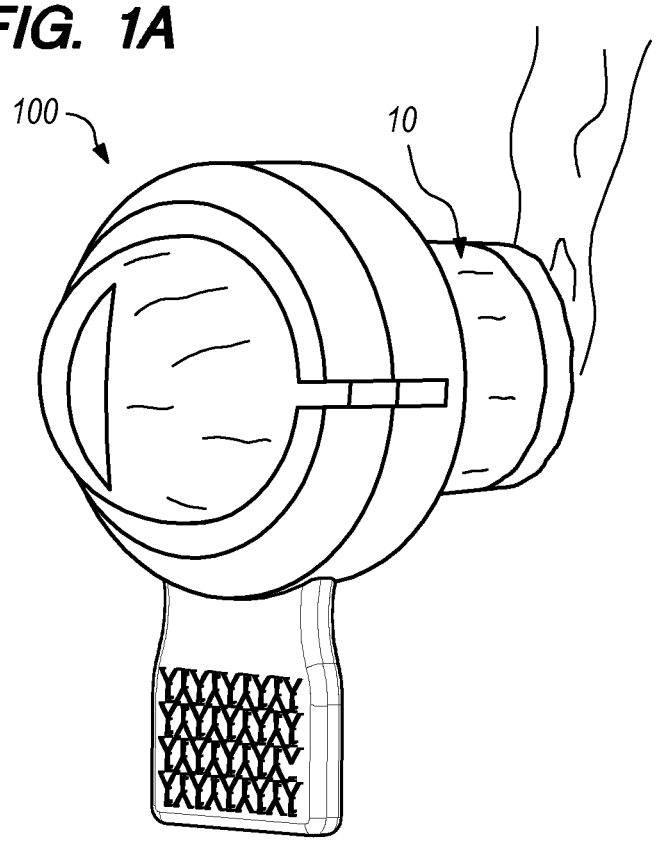
FIG. 1A illustrates a simplified view of a cigar holder resting against the surface of a cigar according to an example embodiment of the present application.

FIG. 1A illustrates a simplified version of the cigar holder resting against the surface of a cigar according to an example embodiment of the present application. Referring to FIG. 1A, the cigar holder 100 is a C-shaped clamp that holds a cigar 10 inserted under the movable top and bottom portions of the clamp, which hinge together at an axis joined by hinge openings on both portions of the clamp which are joined by a pin inserted therebetween. This simplified view is intended to demonstrate a use scenario and is not intended to portray all the specific features of the example embodiments of this application.

Figure 1B:
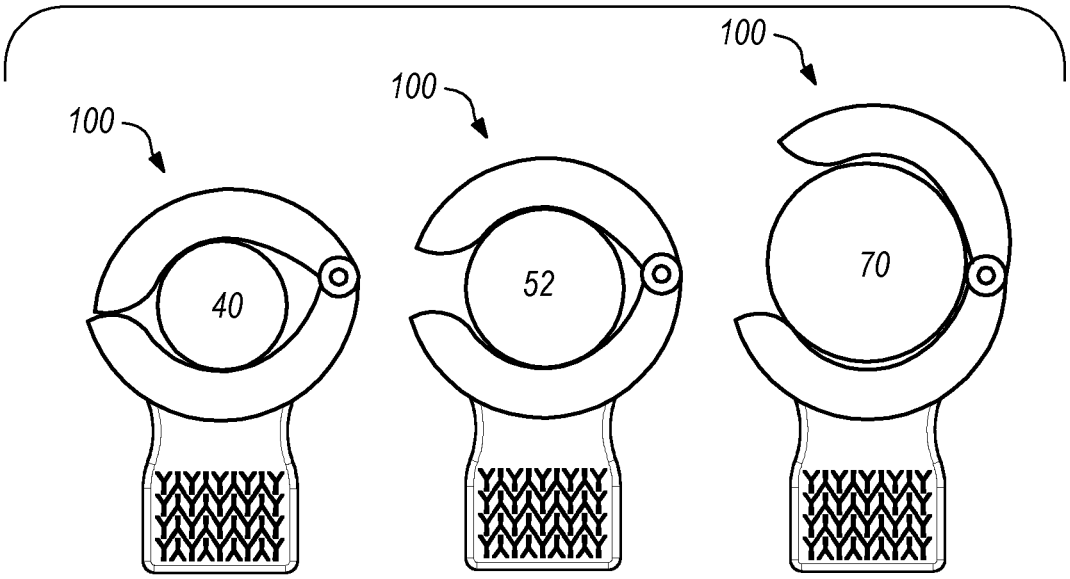
FIG. 1B illustrates examples of the cigar holder resting against the surface of different sized cigars while still maintaining a secure holding position regardless of the different cigar sizes according to example embodiment of the present application.

FIG. 1B illustrates examples of the cigar holder 100 resting against the surface of different sized cigars (e.g., gauges 40, 52, 70, etc.) while still maintaining a secure holding position regardless of the different cigar sizes according to example embodiment of the present application. In this configuration, the cigar holder 100 is illustrated as having various different resting angle positions depending on the gauge of the substantially cylindrical cigar, which in this example demonstrates a measured gauge size of 40, 52 and 70. Any sized cigar between those sizes or even larger or smaller would be held in a resting position under the weight and the spring coefficient of the clamp. In the case of the 40 gauge size, the clamp is in a fully closed position where both clamp portions are touching.

Figure 2A:
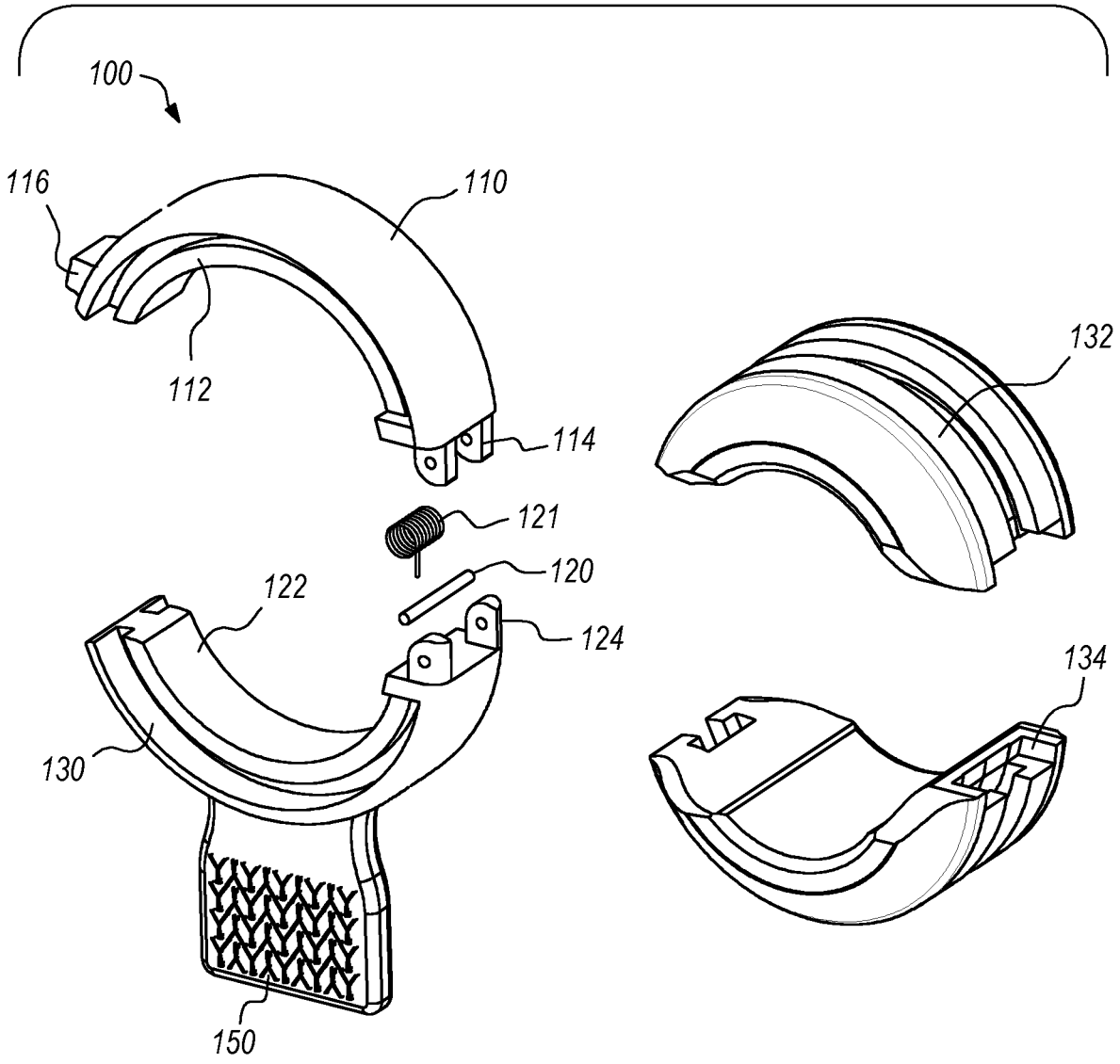
FIG. 2A illustrates an exploded view of the cigar holder from an angled view perspective according to an example embodiment of the present application.

FIG. 2A illustrates an exploded view of the cigar holder from an angled perspective according to an example embodiment of the present application. Referring to FIG. 2A, the C-clamp configuration includes two main portions, the top half of the clamp 110 and the bottom/lower half 130. The top half 110 has a hinge protrusion 114 with a pair of holes for an axis pin 120 to pass through. The hinge protrusions 114 on the top half 110 are set closer together from one another than the hinge protrusions 124 on the bottom half 130 so they may rest against a resting surface of the bottom half 130 inside the distance between the bottom half hinges 124 and be joined to create an axis via the axis pin 120. The lower half 130 also has a handle 150 which is affixed to the clamp and which can be held be a user or inserted into a slot such as a receiving slot of a cigar holder base (see FIG. 6) which could be useful on a table top or other resting surface, etc., when the cigar being held is lit and burning. The top half cavity and track 112, is a recessed portion that invites a top half padding insert 132, as a soft and flexible material to assist with holding the cigar, other types of material include metal, wood, rubber, silicon, etc. Ideally, the material would be soft to touch so as not to create unnecessary deformities in a soft cigar surface. The bottom portion 130 has a separate cavity and track 122 where a lower half padding insert 134 may be form fitted to secure onto the clamp. The weight of the clamp may be relatively heavy, such as a solid metal that can provide weight against the cigar to create a holding position without requiring a spring loaded mechanism. However, in another embodiment, the hinge may be joined with a spring 121, such as a torsion spring, to create more pressure against the inside surface of the clamp if necessary to secure the cigar. Also, a lifting handle 116 is a protrusion on the top portion 110 which may be used to lift the claim up and down.

One example embodiment may include the top portion of the clamp having a cavity in which a material is disposed which is different from a material of the top portion of the clamp, a bottom portion of the clamp having a cavity in which the material is disposed, and a hinge disposed between the top portion of the clamp and the bottom portion of the clamp with a pass-through slot for an axis pin disposed inside a torsion spring with its torsion spring arms resting on both the top portion of the clamp and the bottom portion of the clamp. The bottom portion of the clamp is affixed to an elongated handle extending downwardly from the bottom portion of the clamp. The material is a silicon insert comprising a T-shaped cavity track that form fits over a T-shaped cavity track of the top portion. The silicon insert includes a lip protruding on both sides of the material. The material is a silicon insert having a T-shaped cavity track that form fits over a T-shaped cavity track of the bottom portion. The silicon insert has a lip protruding on both sides of the material. The hinge includes a double-holed slot on a pair of protrusions extending from the top portion and a double-holed slot on a pair of protrusions extending from the bottom portion, and a space between the protrusions on the top portion is smaller than a space between the protrusions on the bottom portion. The clamp also has a stop block affixed to the top portion which prevents movement of the top portion past a particular angle by causing the stop block to engage with the bottom portion.

Figure 2B:
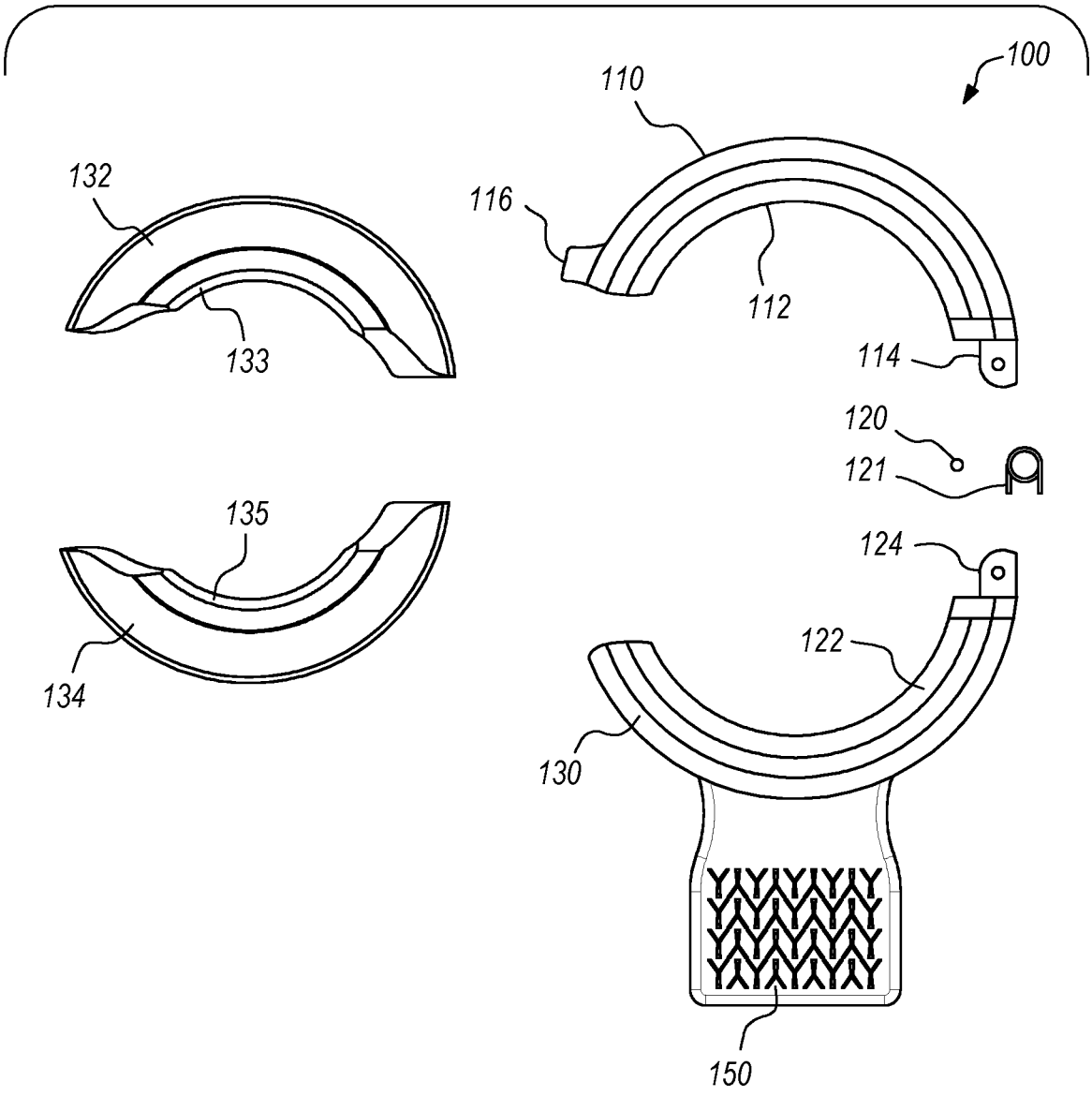
FIG. 2B illustrates an exploded view of the cigar holder with a front view perspective according to an example embodiment of the present application.

FIG. 2B illustrates an exploded view of the cigar holder from a front position according to an example embodiment of the present application. Referring to FIG. 2B, the like reference numerals represent like elements. The insert pads 132 and 134 may have lip protrusions 133 and 135 on both sides of the insert track to meet a user's lips when attempting to puff on the cigar while it is held in the clamp 100.

Figure 2C:
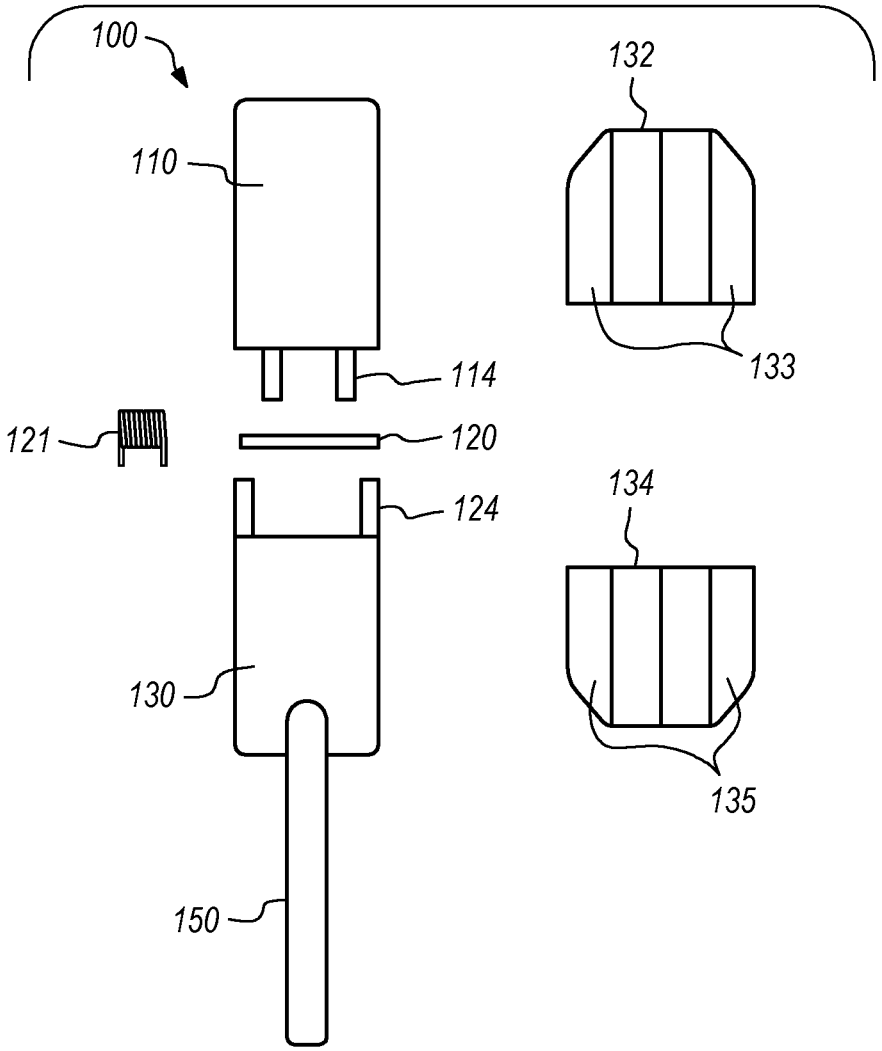
FIG. 2C illustrates an exploded view of the cigar holder from a side view perspective according to an example embodiment of the present application.

FIG. 2C illustrates an exploded side view of the cigar holder according to an example embodiment of the present application. Referring to FIG. 2C, the side view demonstrates how the top half padding insert and the lower half padding inserts 132 and 134 have lip protrusions 133 and 135 on both sides of the inserts. In another embodiment there may be lip protrusions only on one side of the inserts. In another embodiment, the arcuate length of the top half may be larger than the arcuate length of the bottom half and vice versa, however, the sizes of the top and bottom half are generally the same size. Those alternatives permit more curvature on the top half/bottom half to form fit the cigar slightly more efficiently than the other half which depending on the design selected.

Figure 2D:
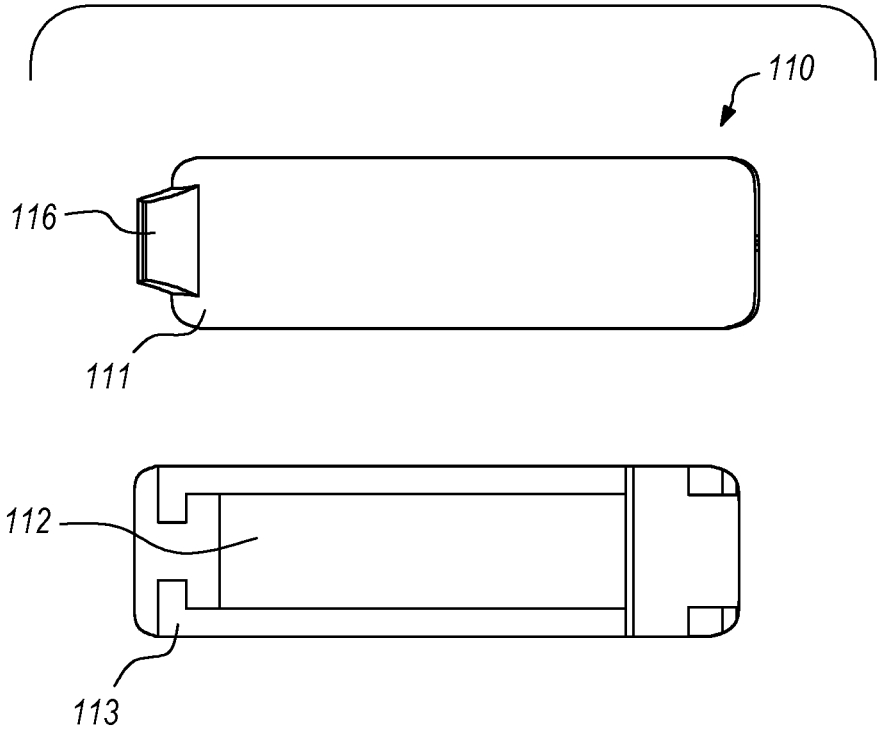
FIG. 2D illustrates a top and bottom view of the top portion of the clamp portion of the cigar holder without the insert portion according to an example embodiment of the present application.

FIG. 2D illustrates a top and bottom view of the top portion of the clamp portion of the cigar holder without the insert portion according to an example embodiment of the present application. Referring to FIG. 2D, the top side 111 of the top half 110 is generally smooth and semi-cylindrical with a protrusion for the lifting handle handle 116. The interior view of the top half illustrates the semi-cylindrical track 112 with a T-shaped lip on both sides to receive and hold the insert 132. The edge of the T-shaped track 113 is hollow while the center 112 is raised to form a hollow T-shaped track. The bottom half 130 may have a similar configuration to the top half 110 and will be omitted from further discussion since the same configuration applies, however, the sizes, lengths, and angles may vary from the top half 110 to the bottom half.

Figure 2E:
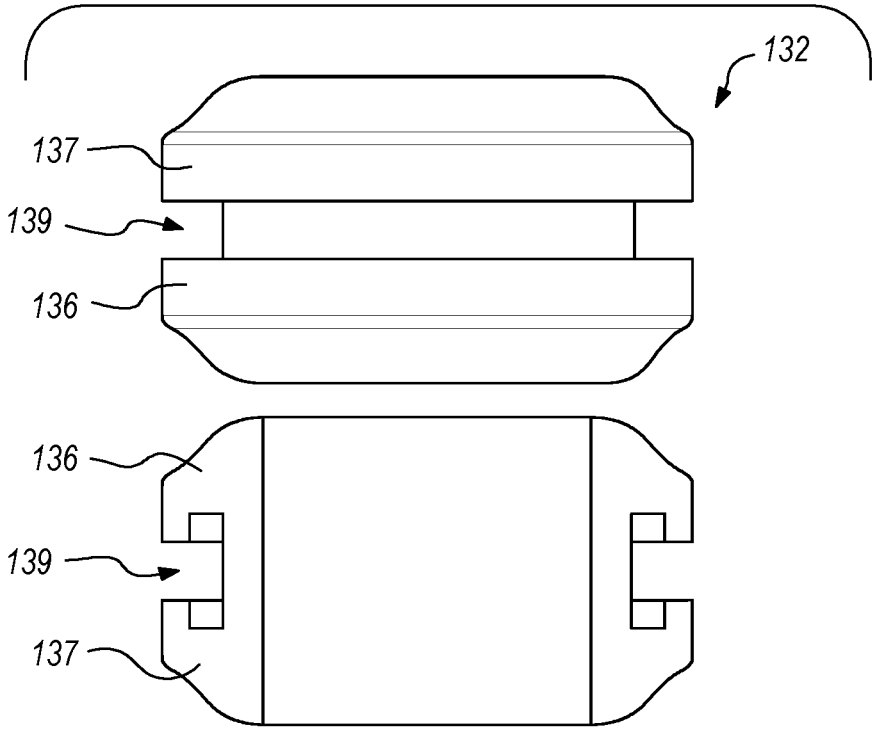
FIG. 2E illustrates a top and bottom view of an insert portion of the clamp according to an example embodiment of the present application.

FIG. 2E illustrates a top and bottom view of an insert portion of the clamp according to an example embodiment of the present application. Referring to FIG. 2E, the top insert 132 has a recessed portion 139 which will fit against the interior surface 112 of the top half 110, while the non-recessed portion will lie over the T-shaped hollow track 113 of the interior surface 112. The recessed portion 139 of the silicon insert 132 is also T-shaped to match the track 112/113 of the top portion 110. One side of the insert is denoted 136 and the other is denoted 137, and both portions are joined together to form a single insert 132.

Figure 3:
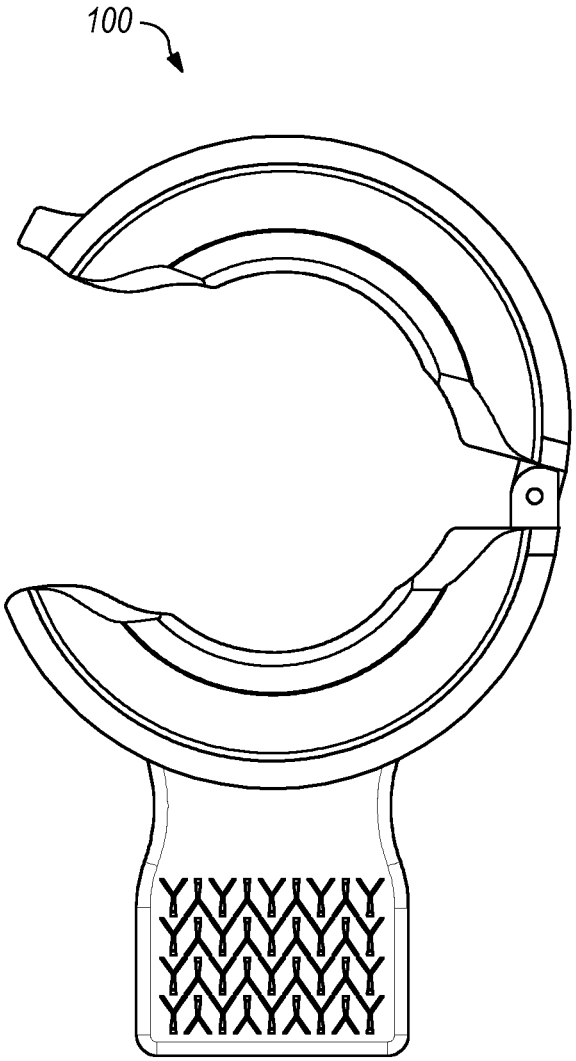
FIG. 3 illustrates a backside view of the cigar holder according to an example embodiment of the present application.

FIG. 3 illustrates a backside view of the cigar holder according to an example embodiment of the present application. In this view, the cigar holder 100 has the inserts snapped into place to create a completed clamp that is ready for use.

Figure 4C:
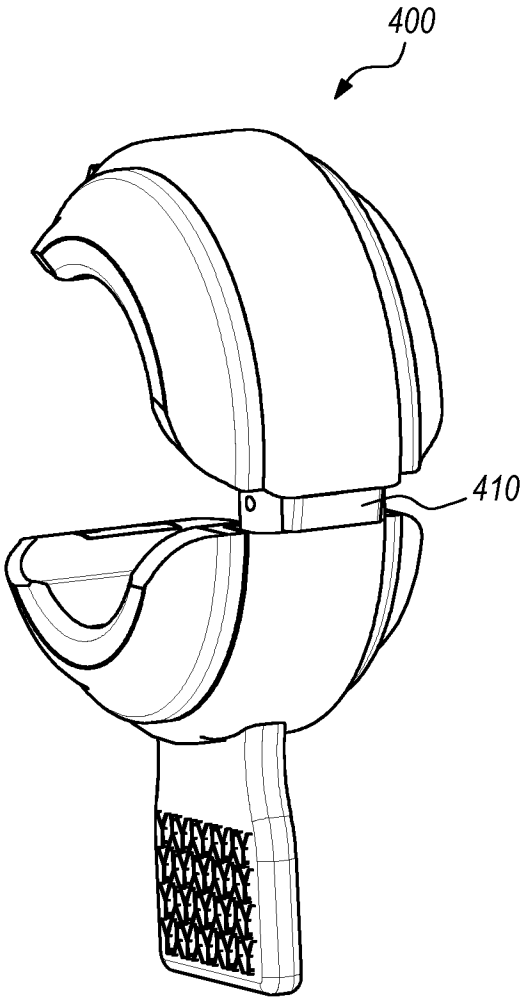
FIGS. 4A-4C illustrate angled perspective views of the cigar holder in a closed, partially opened, and a completely opened position, respectively, and with a stop block section as part of the top clamp portion according to an example embodiment of the present application.
Figure 4B:
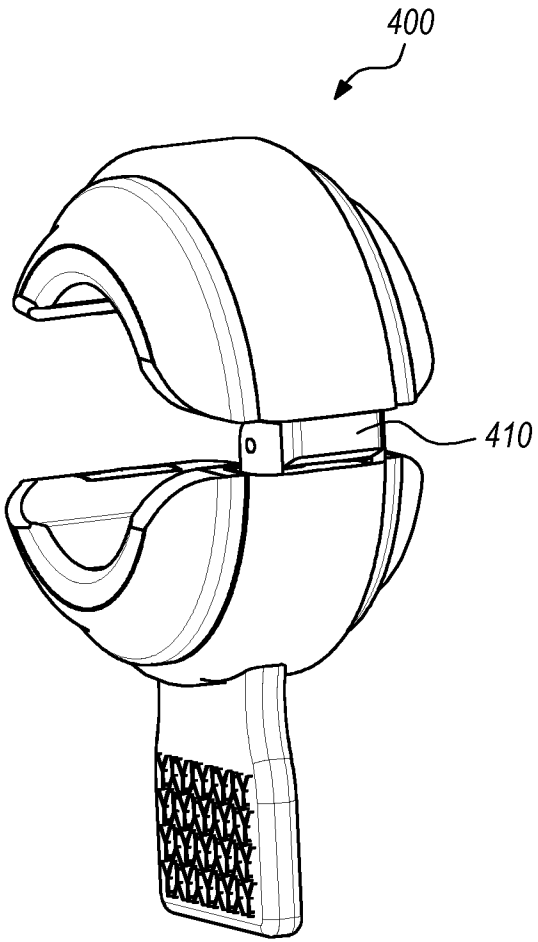
Figure 4A:
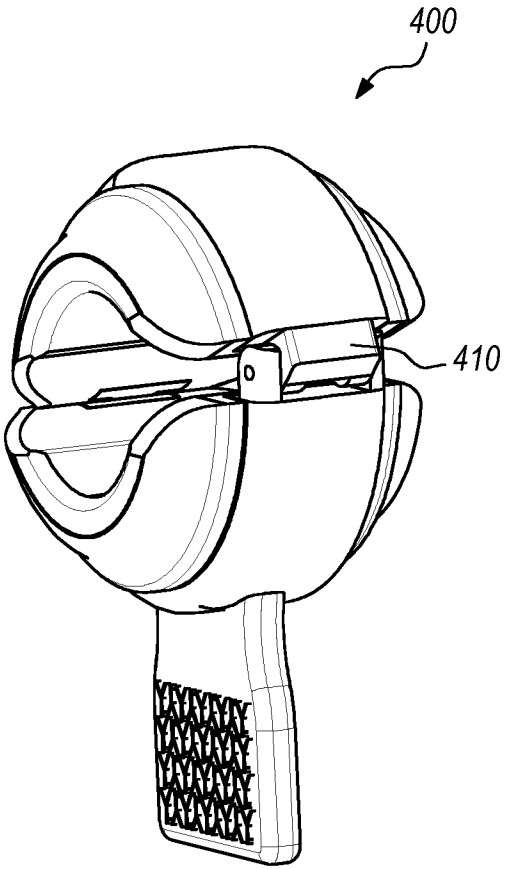
Figure 5A:
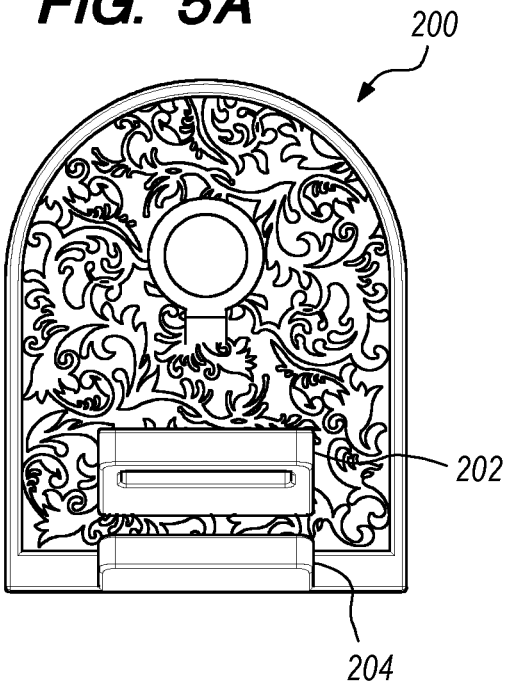
FIGS. 5A-5D illustrate front, angled, sideways front and sideways side view perspectives, respectively, of the cigar holder stand according to an example embodiment of the present application.
Figure 5B:
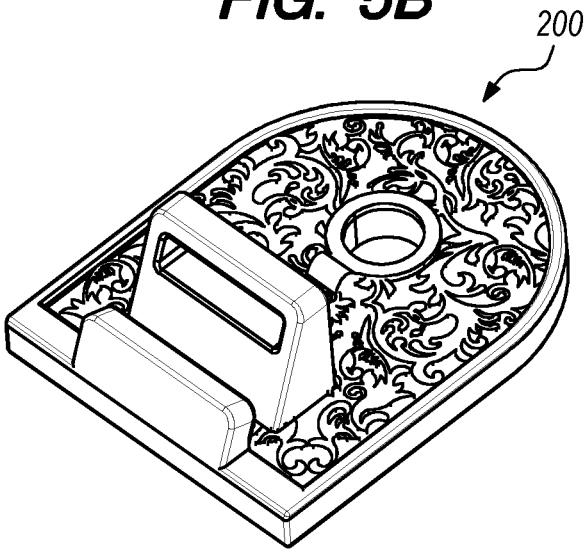
Figure 5C:
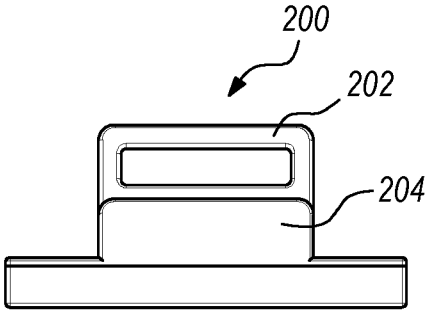
Figure 5D:
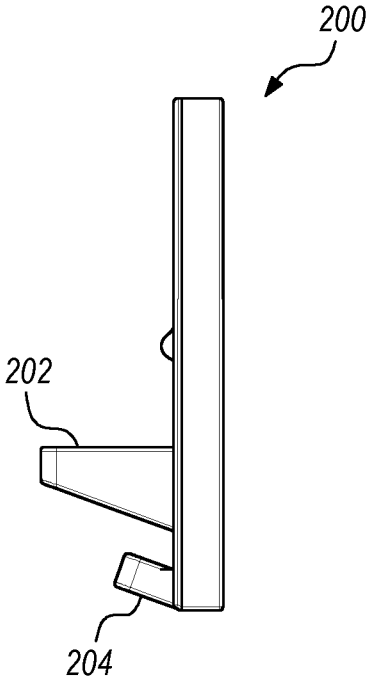

FIGS. 4A-4C illustrate angled perspective views of the cigar holder in a closed, partially opened, and a completely opened position, respectively, and with a stop block section as part of the top clamp portion according to an example embodiment of the present application. Referring to FIG. 4A, the example clamp holder 400 is generally the same as the example 100 however, this embodiment 400 includes a stopping block 410 that has additional material to create a wedge when pushed open. This stopping wedge/block 410 maintains the position when fully opened (see FIG. 4C) by creating a stopping surface that presses against the bottom portion 130. The torsion spring 121 is not strong enough to prevent varying degrees of human strength and thus the stopping block 410 will prevent excessive bending of the torsion spring 121.

FIGS. 5A-5D illustrate front, angled, sideways front and sideways side view perspectives, respectively, of the cigar holder stand according to an example embodiment of the present application. The stand 200 is intended to be a stand-alone plate with an angled stand portion 202 that extends perpendicular to the base portion (see FIG. 5D) and which has an angled ramp on one side to create a parallel pathway that matches the interior angle of the angled shorter stand portion 204 to create a firm resting surface to hold the cigar clamp 100 by the handle 150 in a permanent angled position so the weight is distributed backwards to prevent a flip over event which could lead to a fire hazard. The taller portion 202 also has a pass-through slot shaped rectangularly to receiving the handle of the cigar holder in a resting storage position (see FIG. 6).

Figure 6:
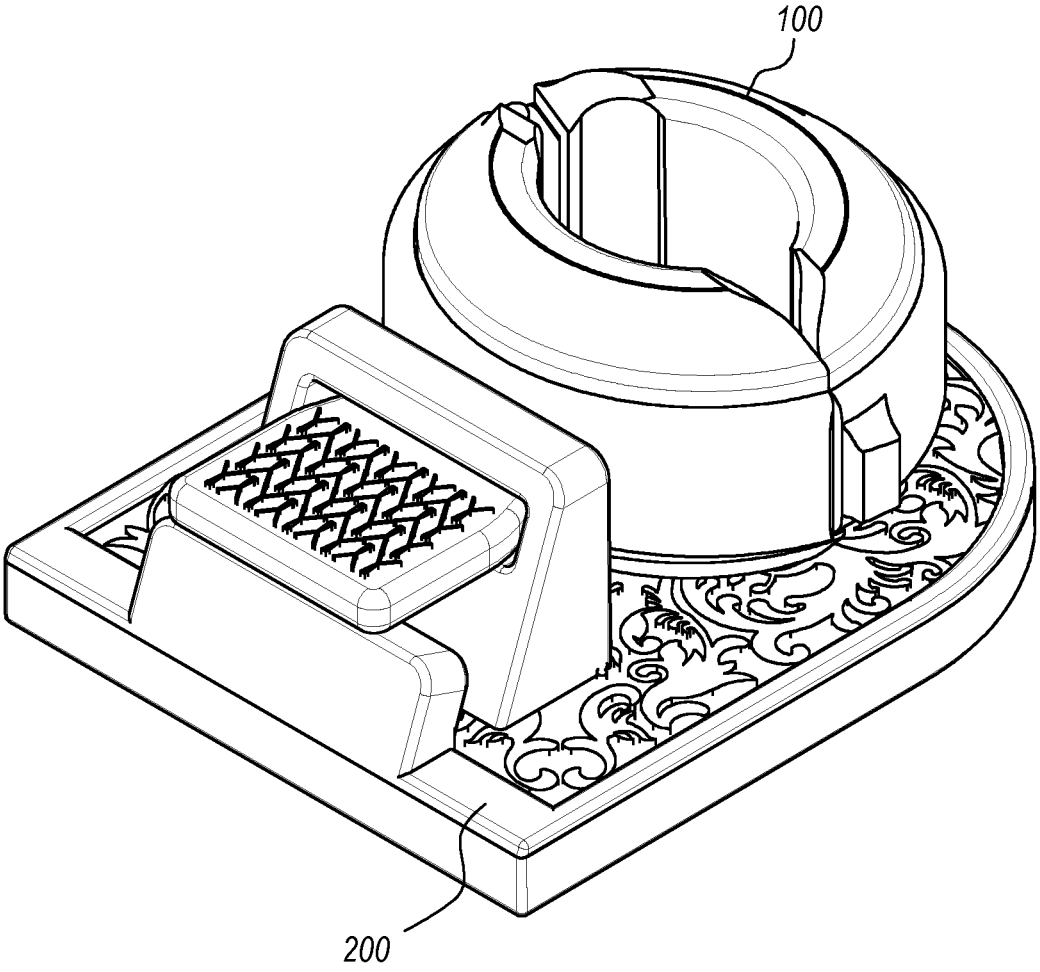
FIG. 6 illustrates an angled view perspective of the cigar holder and cigar holder stand in a flat storing position according to an example embodiment of the present application.

FIG. 6 illustrates an angled view perspective of the cigar holder in a flat storing position according to an example embodiment of the present application. As may be observed, the resting position permits the cigar holder 100 to be laid flat and to be easily carried in a pocket or pouch. The handle 150 passes through the pass-through slot of the taller portion 202 and rests against the top of the short stand portion 204. The cigar holder 100 may then be held in place for storage and travel.

Another example embodiment may include a top portion of a clamp, a bottom portion of the clamp hinged to the top portion via an axis pin and a torsion spring, and the bottom portion of the clamp includes a handle, and a base plate with two angled protrusions, the first angled protrusion being taller in height than the second angled protrusion, and wherein the handle rests between the two angled protrusions to hold the clamp in an angled position. The first angled protrusion has a rectangular pass-through slot with a wider distance than a distance of the handle so the handle can pass-through the slot. The stop block is affixed to the top portion which prevents movement of the top portion past a particular angle by causing the stop block to engage with the bottom portion.

It will be readily understood that the components of the invention, as generally described and illustrated in the figures herein, may be arranged and designed in a wide variety of different configurations. Thus, the detailed description of the embodiments is not intended to limit the scope of the invention as claimed, but is merely representative of selected embodiments of the invention.

One having ordinary skill in the art will readily understand that the invention as discussed above may be practiced with steps in a different order, and/or with elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

While preferred embodiments of the present application have been described, it is to be understood that the embodiments described are illustrative only and the scope of the application is to be defined solely by the appended claims when considered with a full range of equivalents and modifications thereto.

What is claimed is:

1. An apparatus comprising:

a top portion of a C-shaped clamp comprising a T-shaped track with comprising a first cavity on a front surface of the top portion in which a first half padding insert of a different material is disposed which is different from a material of the top portion of the C-shaped clamp, and a second cavity on a rear surface of the top portion, wherein the first half padding insert protrudes past and covers a surface area of the front surface and the rear surface of the top portion, and wherein the first half padding insert comprises a T-shaped cavity to fit over the T-shaped track of the top portion; and a bottom portion of the C-shaped clamp comprising a T-shaped track with comprising a first cavity on a front surface of the bottom portion in which a second half padding insert of the different material is disposed, and a second cavity on a rear surface of the bottom portion, wherein the second half padding insert protrudes past and covers a surface area of the front surface and the rear surface of the bottom portion, and wherein the second half padding insert comprises a T-shaped cavity to fit over the T-shaped track of the top portion; and a hinge disposed between the top portion of the C-shaped clamp and the bottom portion of the C-shaped clamp with a pass-through slot for an axis pin disposed inside a torsion spring comprising torsion spring arms resting on both the top portion of the C-shaped clamp and the bottom portion of the C-shaped clamp, and wherein the first and second half padding inserts and the top and bottom portions of the C-shaped clamp are arcuately shaped and together form the C-shaped clamp in a closed position.

2. The apparatus of claim 1, wherein the bottom portion of the C-shaped clamp is affixed to an elongated handle extending downwardly from the bottom portion of the C-shaped clamp.

3. The apparatus of claim 1, wherein the different material is a silicon insert and wherein the material is metal.

4. The apparatus of claim 1, wherein the hinge comprises a double-holed slot on a pair of protrusions extending from the top portion and a double-holed slot on a pair of protrusions extending from the bottom portion, and wherein a space between the protrusions on the top portion is smaller than a space between the protrusions on the bottom portion.

5. The apparatus of claim 1, comprising a stop block affixed to the top portion which prevents movement of the top portion past a particular angle by causing the stop block to engage with the bottom portion.

* * * * *